United States Patent [19]

Strandgard

[11] 4,042,246

[45] Aug. 16, 1977

[54] BOARD GOLF GAME

[76] Inventor: Larry W. Strandgard, 336 Elgin Ave., Forest Park, Ill. 60130

[21] Appl. No.: 636,755

[22] Filed: Dec. 1, 1975

[51] Int. Cl.[2] ..... A63F 3/00

[52] U.S. Cl. ..... 273/134 CG

[58] Field of Search ..... 273/134

[56] References Cited

U.S. PATENT DOCUMENTS

| | | | |
|---|---|---|---|
| 1,334,176 | 3/1920 | Seagrave | 273/134 ES |
| 1,482,330 | 1/1924 | Treboul | 273/134 CG UX |
| 1,735,794 | 11/1929 | Ristow | 273/134 CG |
| 2,230,332 | 2/1941 | Moore | 273/134 E |
| 3,421,376 | 1/1969 | Lindahl | 273/134 CG X |
| 3,697,072 | 10/1972 | Park | 273/134 CG X |
| 3,857,568 | 12/1974 | Yoder | 273/134 CG |

FOREIGN PATENT DOCUMENTS

| | | | |
|---|---|---|---|
| 16,519 | 9/1896 | United Kingdom | 273/134 CG |

*Primary Examiner*—Delbert B. Lowe

[57] ABSTRACT

A game board is provided having a simulated golf course depicted thereon, the golf course including areas simulating a tee, fairway, green, water hazards, sand traps, trees and roughs. A plurality of tokens are provided, each one representing a golf ball for a respective player. The game board has a plurality of paths to the green, each path simulating the path of a drive and approach shot to the green, and a plurality of positions on the green, at least one of the paths being arranged to lead down the fairway and one of the paths arranged to lead into and out of at least one of the water hazards, sand traps, trees and roughs, each of the paths beginning at a starting point at a tee position on the tee and joining one another at a point of intersection on the green. Dice are provided for operation by a player for randomly signifying travel of a respective golf ball along one of the paths through randomly selectable indicia on the dice.

5 Claims, 2 Drawing Figures

FIG. 1
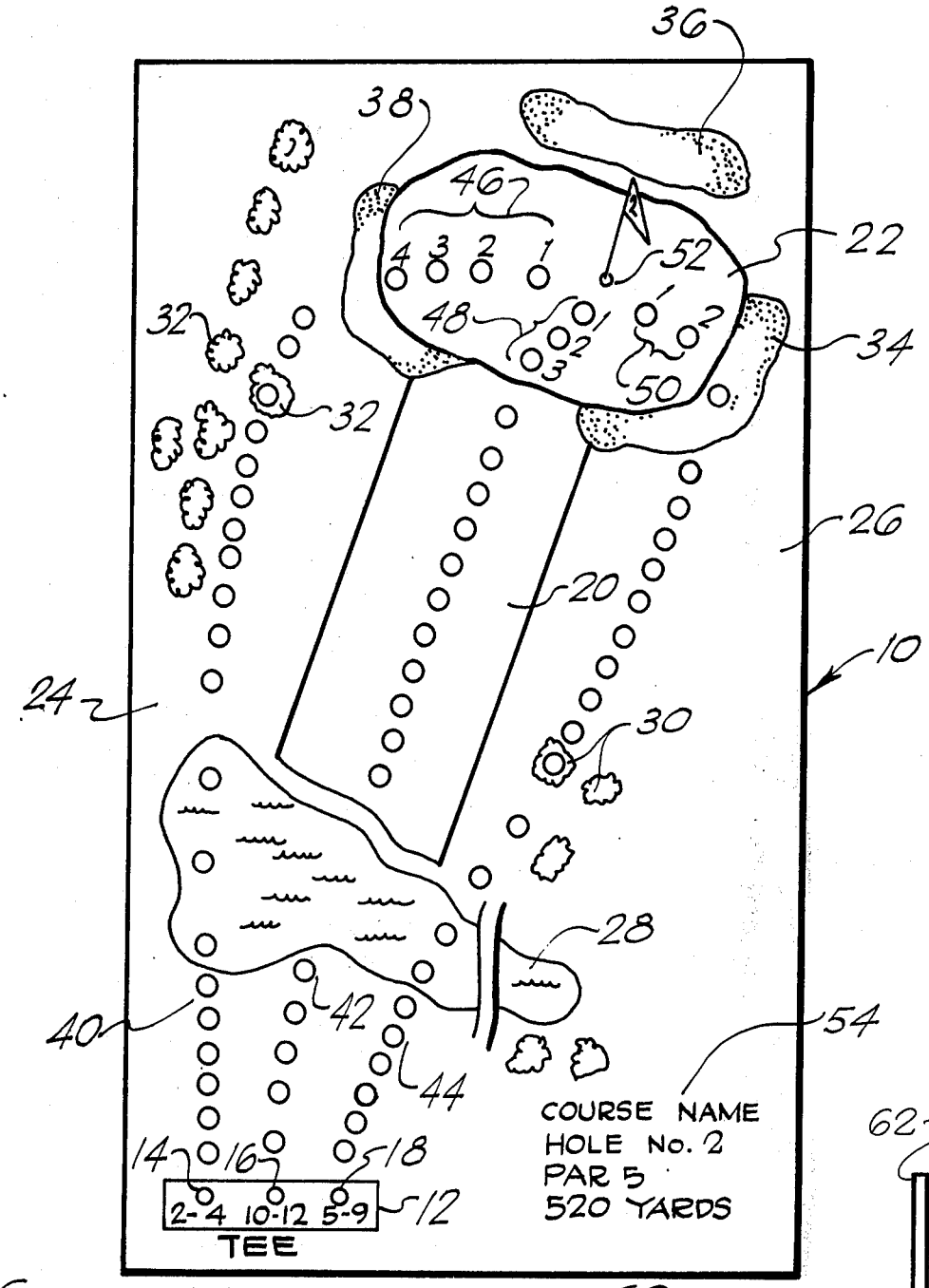
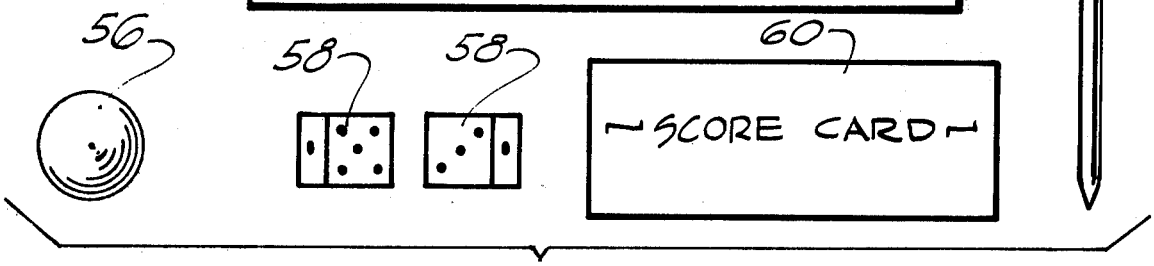
FIG. 2

BOARD GOLF GAME

SUMMARY OF THE INVENTION

The present invention relates to a golf game comprising a game board having a simulated golf course depicted thereon; the golf course including areas simulating a tee, fairway, green, water hazards sand traps, trees and roughs. A plurality of paths are provided to the green, each path simulating drive and approach shots to the green and a plurality of positions on said green; at least one of the paths being arranged to lead down the fairway, and at least one of the paths being arranged to lead into and out of at least one of the water hazards, sand traps, trees and roughs; each of the paths beginning at a starting point at a tee position on the tee and joining one another at a point of intersection on the green. Each of the paths comprises a plurality of pre-marked and pre-determined positions representative of the position of a golf ball during play. Chance means such as die means, by which it is intended to include either a single die or a plurality of dice, are employed for operation by a player for randomly signifying travel of a respective token along one of the paths through randomly selectable indicia on the chance means. Each of the tee positions are chosen according to the indicia a player initially obtains on the chance means. The game also includes a plurality of tokens where each token represents a golf ball for a respective player during play, each of the tokens adapted to be moved manually to one of the positions on the paths according to the indicia a player obtains on the chance means.

BRIEF DESCRIPTION OF THE SEVERAL VIEWS OF THE DRAWING

FIG. 1 illustrates a game board of a golf game according to one embodiment of the present invention.

FIG. 2 illustrates chance means, i.e. dice, a token, i.e. a marble, a score card and a grease pencil for marking the score card with scores during play of the game, the score card having a surface thereon which is erasable with respect to the grease pencil according to another embodiment of the present invention.

DETAILED DESCRIPTION

The present invention relates to a golf game comprising a game board having a simulated golf course depicted thereon and a plurality of paths from the tee to the green wherein each path simulates a drive and an approach shot to the green, each path also leading to a plurality of positions on the green, the plurality of paths terminating in a single point on the green. The prior art discloses golf games comprising game boards depicting a golf course, such as U.S. Pat. No. 1,546,837 to Johnson; however, it does not show a path leading to a plurality of positions on the green, nor does the Johnson game board realistically depict a golf course on the game board. Other golf games utilizing a game board depicting a golf course or a hole of a golf course are known, such as those disclosed in U.S. Pat. Nos. 3,857,568 Yoder; 3,826,498 Monek; 3,658,339 Boileau; 3,355,175 Carroll et al.; 3,238,079 Scheib; 1,640,699 Gaston; 1,635,489 McColm; 1,541,202 Winbigler; 1,535,126 McNair et al.; 1,529,598 Lee, Jr. and 1,513,941 Smith.

It is therefore an object of the present invention to provide a novel golf game.

It is a further object of the present invention to provide a golf game comprising a board depicting a golf course that is realistic in appearance.

It is a further object of the present invention to provide a golf game that offers a new mode of play.

These and other objects have been achieved according to the present invention and will become apparent by reference to the disclosure and claims that follow as well as to the appended drawings.

Referring to the drawings and FIGS. 1 and 2, a golf game 10 is illustrated in game board fashion comprising a tee 12, a plurality of starting positions 14, 16 and 18 having numerical values depicted under each position, the starting positions 14, 16 and 18 corresponding respectively to a plurality of paths 40, 42 and 44. A fairway 20 in front of tee 12 leads to green 22, rough areas 24 and 26 being provided on either side of the tee, fairway and green, water hazard 28, trees 30 and 32 and sand traps 34, 36 and 38 being provided as hazards. A plurality of paths 40, 42 and 44 are provided between the tee 12 and the green 22, each path simulating drive and approach shots to the green 22, at least one of the paths such as path 42 being arranged to lead down the fairway 20 and at least one of the paths such as path 44 and/or path 40 being arranged to lead into and out of at least one of the water hazards such as water hazard 28, roughs 24 and/or 26, trees 30 and/or 32 and sand trap 34. The paths 40, 42 and 44 starting at tee 12 join one another at green 22 at a point of intersection 52 which is represented as a hole and pin. The paths 40, 42 and 44 each comprise a plurality of positions that are premarked and pre-determined, representative of the positions of a golf ball during play. Tokens 56 which simulate a golf ball are provided and comprise spheres individually coded for the identification of each token by the respective players who use the tokens during play of the game 10. Chance means operable by a player for randomly signifying travel of a respective token or golf ball along one of the paths and which have randomly selectable indicia thereon are provided, an example of such chance means being die means 58 by which it is intended to include a single die or a plurality of dice. Other chance means such as a wheel and pointer or the art known equivalents thereof as well as the art known equivalents of such die means are also intended to be included as falling within the board definition of the chance means employed according to the present invention.

A score card 60 and a grease marking pencil 62 are also provided, the score card having a surface that is receptive to the markings of pencil 62, such surface being erasable so that the score card can be re-used.

Paths 40, 42 and 44 lead respectively to a plurality of positions 46, 48 and 50 on green 22, each of which indicates the number of strokes that respective player is from hole and pin 52. The lower corner of the game 10 has markings indicating the course name, which may be inserted by the player or manufacturer of the game 10, the hole number, the par and the distance in yards.

In one embodiment an aerial photograph of a golf course is used in providing the game 10 and the tee 12 imposed on the photograph in the area of the tee and the paths such as paths 40, 42 and 44 leading respectively to positions 46, 48 and 50 on green 22 are imposed on the photograph in the areas of the fairway, green, roughs, sand traps, trees and water hazards depicted on the photograph.

In use game 10 is played by each player operating the chance means to get a number that will signify his starting position at tee 12. For example, if dice 58 are employed as the chance means, players rolling a number on the dice from two to four would take position 14 and would continue play of the hole along path 40 and positions 46 on green 22. The other players would also roll dice 58 to determine their starting positions and the game off the tee would begin. Each player would then roll the dice in turn depending either on the score of the previous hole in accord with regular golf rules or, if no previous hole has been played, by the toss of a chance means or a coin. A roll of the dice 58 counts as a stroke and will determine how far each player may move their token 56. When the players on paths 40 and 42 get caught in the water hazard 28 or trees 30 or 32 by landing thereon they are penalized one stroke. If a player gets caught in a sand trap such as trap 34 they must roll doubles on dice 58 to get out of the trap according to one embodiment of the present invention. In this aspect of the invention double ones to threes on dice 58 will get the player out and he will be deemed to have putted out in two strokes whereas double fours to sixes will be considered as a one putt. Each attempt at rolling doubles is counted as a stroke. When the players on paths 40, 42 and 44 approach the green 22 they will roll the dice in an attempt to land in any of the respective positions 46, 48 and 50 and ultimately in hole 52. If for example a player on path 40 lands on any one of the positions numbered 46 from one through four of positions 46 they will be deemed to have holed out in from one to four putts depending on the value of the position that they landed on. If a player is unsatisfied with a four putt he may roll the dice again and try to get closer to the pin 52. If a player rolls the dice and exceeds the number of positions open to them, for example, at positions 46 which are approached through path 40, they may move their token into any of the remaining positions 48 or 50, this choice being open to the player or if need be beyond positions 48 or 50 and onto paths 42 or 44 thus simulating overshooting the green.

By the arrangement of the paths on the game 10 varying degrees of difficulty can be created for each path as in a real golf game, the paths to the left and right of the fairway simulating a hook and a slice shot. If two dice are used, the path leading up the fairway can be in multiples of seven since this is the most likely number to appear on the dice, thereby making this the most desired path to obtain. Since the likelihood of obtaining sixes or eights is less than that of obtaining a seven on the dice, the paths through the rough can be in multiples of these numbers. The hazards can also be placed anywhere but if placed at intervals that are in multiples of seven, there would be a greater likelihood of the players having these hazards in their way and would shoot into them. Knowing the odds of obtaining a number on the dice will enable a player to make moves on his approach shot to the green 22 that will get him as close as possible to the pin and hole 52; however, as in golf, there is always a risk that the ball will not be placed where it is desired.

Although the invention has been described by reference to some embodiments it is not intended that the novel golf game be limited thereby but that modifications thereof are intended to be included as falling within the broad scope and spirit of the foregoing disclosure and the following claims, as well as the appended drawing.

What is claimed is:

1. A golf game comprising a game board having a simulated golf course hole depicted thereon; the golf course including areas simulating a tee, fairway, green, water hazards, sand traps, trees and roughs; a plurality of paths to said green; each path simulated drive and and approach shots to said green and having a plurality of positions on said green; at least one of said paths being arranged to lead down said fairway and at least one of said paths being arranged to lead into and out of at least one of said water hazards, sand traps, trees and roughs; each of said paths beginning at a starting point at one of a plurality of tee positions on said tee and joining one another at a point of intersection on said green; each of said paths comprising a plurality of premarked and pre-determined positions representative of the position of a golf ball during play; chance means for operation by a player for randomly signifying travel of a respective token along one of said paths through randomly selectable indicia on said chance means; each of said tee positions having thereon a different plurality of indicia each of which may be chosen individually by operation of said chance means; a plurality of tokens where each token represents a golf ball for a respective player during a play; each of said tokens adapted to be moved manually to one of said path positions according to the indicia a player obtains on said chance means, said simulated golf course comprising an aerial photograph of a golf course having said tee positions imposed on said photograph in the area of the tee depicted on said photograph, said paths being imposed on said photograph in the area of the fairway, green, roughs, sand traps, trees and water hazards depicted on said photograph.

2. The golf game of claim 1 wherein said path positions comprise insets in said game board along said paths adapted to receive said tokens.

3. The golf game of claim 2 wherein said tokens comprise spheres individually coded for the identification of each token by the respective players using said tokens in play.

4. The golf game of claim 2 wherein said chance means comprises die means.

5. The golf game of claim 1 wherein said chance means comprises die means.

* * * * *